US009345333B2

(12) United States Patent
Gorgi

(10) Patent No.: US 9,345,333 B2
(45) Date of Patent: May 24, 2016

(54) ARMREST, IN PARTICULAR FOR OFFICE CHAIRS

(71) Applicant: Claudio Gorgi, Rossano Veneto (IT)

(72) Inventor: Claudio Gorgi, Rossano Veneto (IT)

(73) Assignee: IMARC S.P.A., Rossano Veneto (VI) (IT)

( * ) Notice: Subject to any disclaimer, the term of this patent is extended or adjusted under 35 U.S.C. 154(b) by 0 days.

(21) Appl. No.: 14/365,630

(22) PCT Filed: Jan. 24, 2013

(86) PCT No.: PCT/EP2013/051320
§ 371 (c)(1),
(2) Date: Jun. 14, 2014

(87) PCT Pub. No.: WO2013/113610
PCT Pub. Date: Aug. 8, 2013

(65) Prior Publication Data

US 2014/0354026 A1 Dec. 4, 2014

(30) Foreign Application Priority Data

Feb. 1, 2012 (IT) ..... VE2012A0004

(51) Int. Cl.
*A47C 7/54* (2006.01)
*A47C 1/03* (2006.01)

(52) U.S. Cl.
CPC .... *A47C 7/54* (2013.01); *A47C 1/03* (2013.01)

(58) Field of Classification Search
CPC ..... A47C 1/03; A47C 7/54
USPC ..... 297/411.35–411.37, 411.31
See application file for complete search history.

(56) References Cited

U.S. PATENT DOCUMENTS

| | | | | | |
|---|---|---|---|---|---|
| 5,382,079 | A * | 1/1995 | Wilson et al. | 297/411.36 | |
| 5,415,459 | A * | 5/1995 | Schultz | 297/411.37 | |
| 5,839,786 | A * | 11/1998 | Cvek | 297/411.35 | |
| 5,927,811 | A * | 7/1999 | Tseng | A47C 1/03 | 297/411.31 X |
| 6,059,366 | A * | 5/2000 | Hu | B60N 2/46 | 297/411.31 |
| 6,460,932 | B1 * | 10/2002 | Kopish et al. | 297/411.36 | |
| 6,619,746 | B2 * | 9/2003 | Roslund, Jr. | A47C 1/03 | 297/411.31 |
| 6,663,182 | B1 * | 12/2003 | Dolci et al. | 297/411.35 | |
| 6,948,774 | B2 * | 9/2005 | Maier | A47C 1/03 | 297/411.31 |
| 6,948,775 | B2 * | 9/2005 | Tsai | 297/411.37 | |
| 6,957,866 | B1 * | 10/2005 | Cai | 297/411.35 | |
| 6,974,190 | B1 | 12/2005 | Hung | | |
| 7,201,450 | B1 | 4/2007 | Chen | | |
| 7,367,628 | B1 * | 5/2008 | Tsai | 297/411.35 | |
| 7,648,207 | B2 * | 1/2010 | Lai | A47C 1/03 | 297/411.31 |
| 8,287,046 | B1 * | 10/2012 | Wang | A47C 7/546 | 297/411.31 X |
| 2006/0250018 | A1 | 11/2006 | Tsai | | |
| 2009/0195045 | A1 * | 8/2009 | Lai | 297/411.35 | |
| 2011/0248543 | A1 | 10/2011 | Hitchcock et al. | | |
| 2011/0254340 | A1 * | 10/2011 | Hsuan-Chin | A47C 1/03 | 297/411.31 |
| 2012/0119557 | A1 * | 5/2012 | Fang | 297/411.35 | |

* cited by examiner

*Primary Examiner* — Rodney B White
(74) *Attorney, Agent, or Firm* — Themis Law

(57) ABSTRACT

An armrest, in particular for office chairs, comprising a support bracket (16) connected to the chair, a tube (34) connected to the vertical part (24) of said bracket, and an arm support pad, characterized in that the tube presents at one end a flange (36) comprising rotation guides for a plate (66), said plate presenting an aperture (66) for the insertion of the lower end of the tube and being provided with rotation guides (38) cooperating with said flange (36) for the rotation of said plate (66) about said tube (34), said plate (66) and said pad (80) being constrained by mutually cooperating slide guides (74, 78) which enable said pad (80) to translate relative to said plate (66) with said flange (36) interposed between them.

8 Claims, 6 Drawing Sheets

ARMREST, IN PARTICULAR FOR OFFICE CHAIRS

The present invention relates to an armrest, in particular for office chairs.

Armrests are known consisting of a substantially L-shaped support bracket with the end of the horizontal part connected to the chair frame and the upper end of the vertical part carrying a pad on which the user's arm rests.

These known armrests are provided with a multiplicity of adjustment elements for satisfying the most varied ergonomic requirements of the user.

In particular, said elements enable the following to be adjusted:

- width: distance between the right pad and left pad of the chair,
- height: top of the pad from the upper surface of the seating portion,
- depth: distance of the pad from the back resting surface,
- angularity: pad orientation to the forearm.

These known armrests present however the drawback of consisting of an assemblage of a large number of small metal and plastic parts with the inconvenience of having to use tools and specialized labour for their assembly.

Another drawback is the fact that these armrests, being totally factory assembled, prove to be bulky products which are difficult to store and transport, with consequent relative costs.

U.S. Pat. No. 6,974,190 B1 discloses an armrest including a steam and a sleeve defining a cavity, with the steam being movable relative to the steam.

An object of the invention is to provide an armrest which can be assembled rapidly without the use of tools.

These and other objects which will be apparent from the ensuing description are attained according to the invention by an armrest, in particular for office chairs, as described in claim 1.

Figure 1:
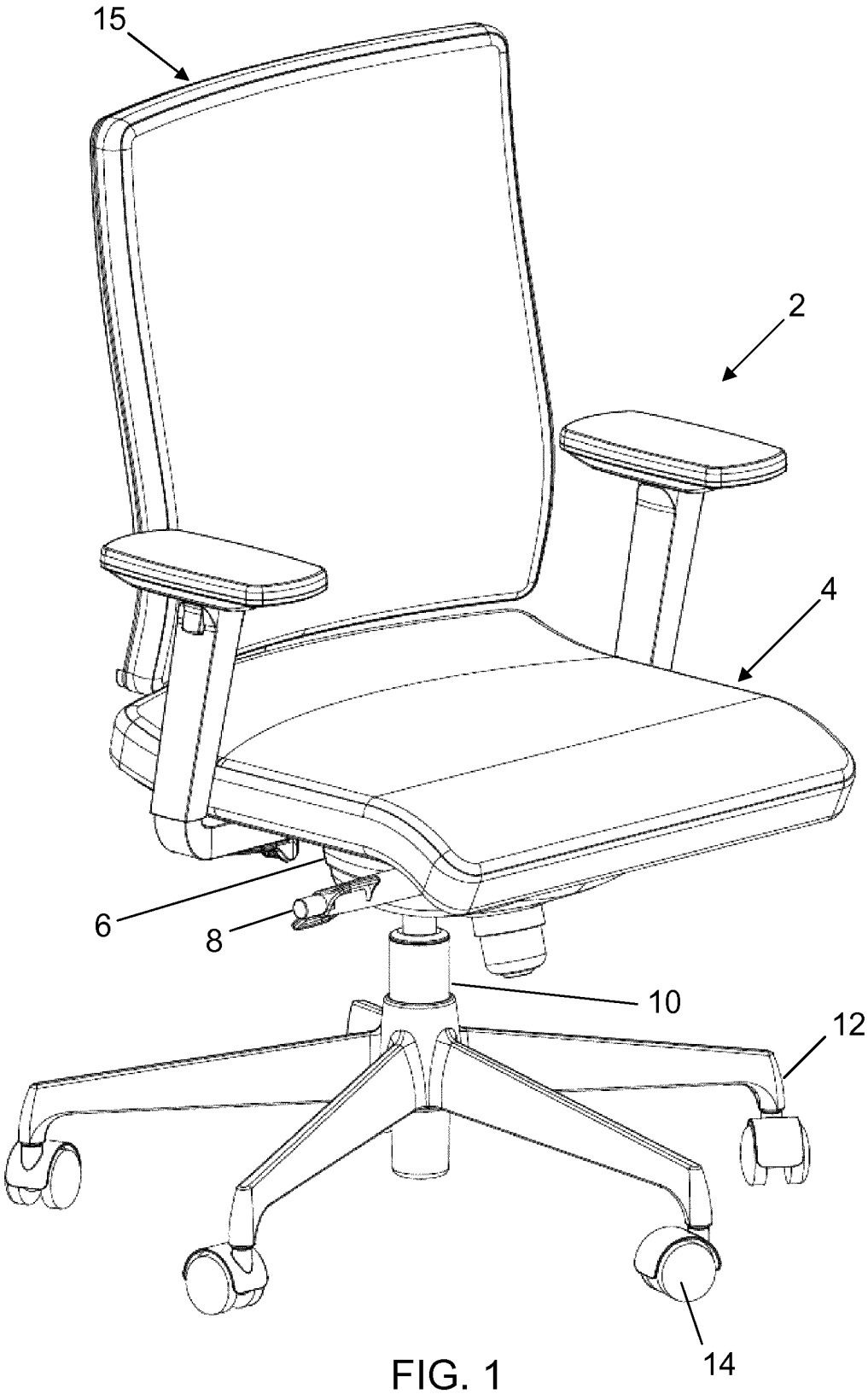
Figure 2:
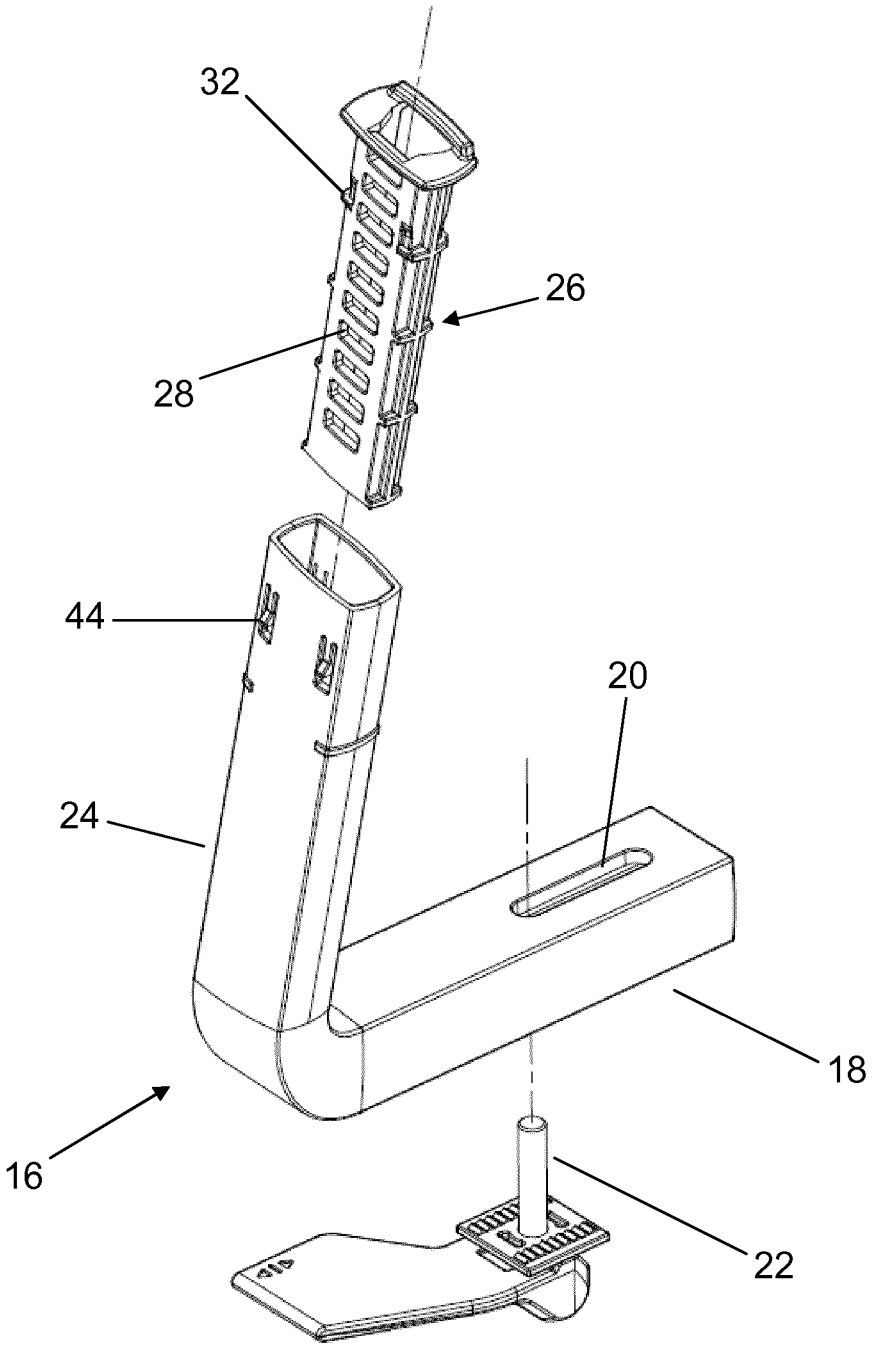
Figure 3:
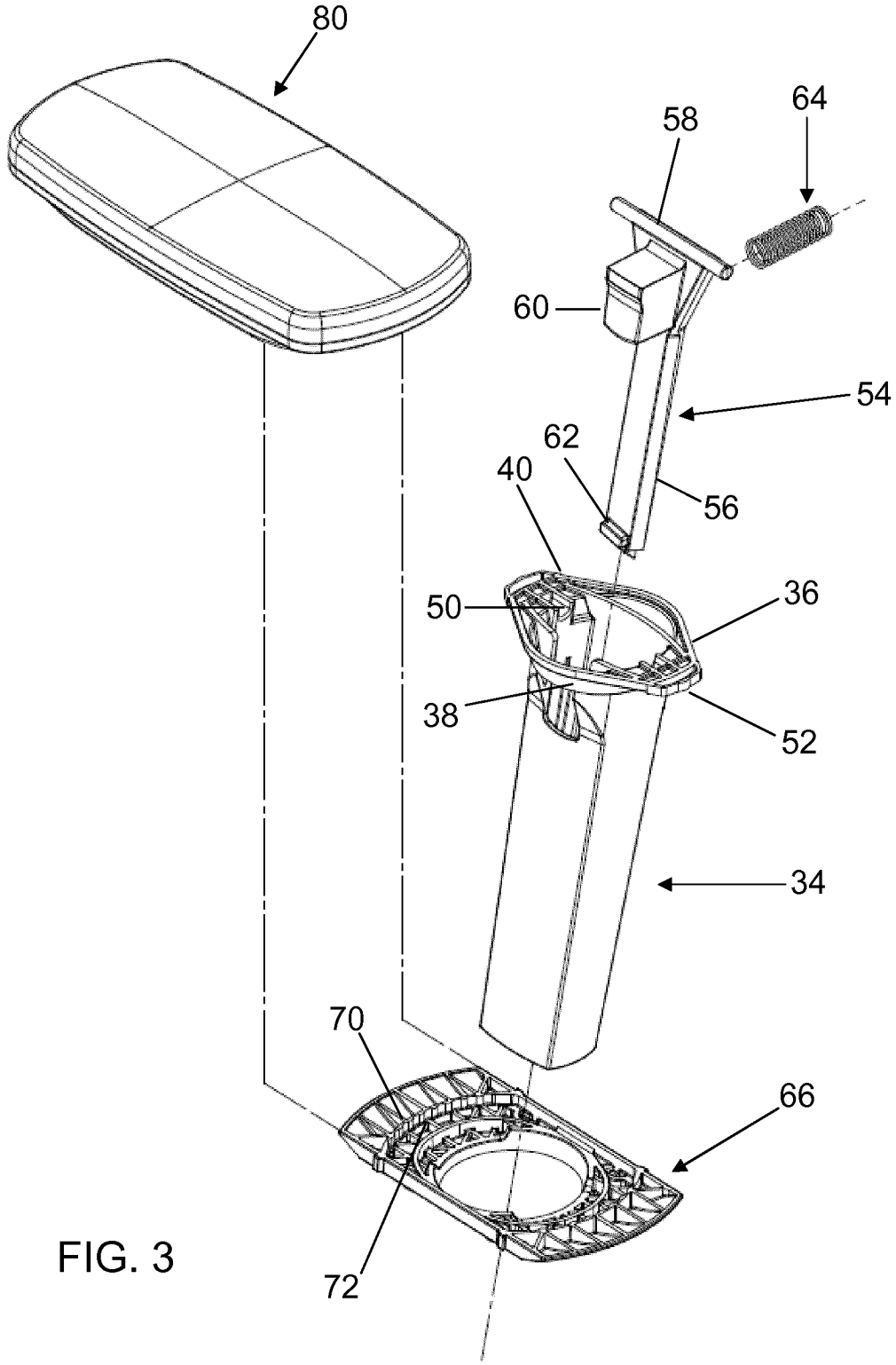
Figure 4:
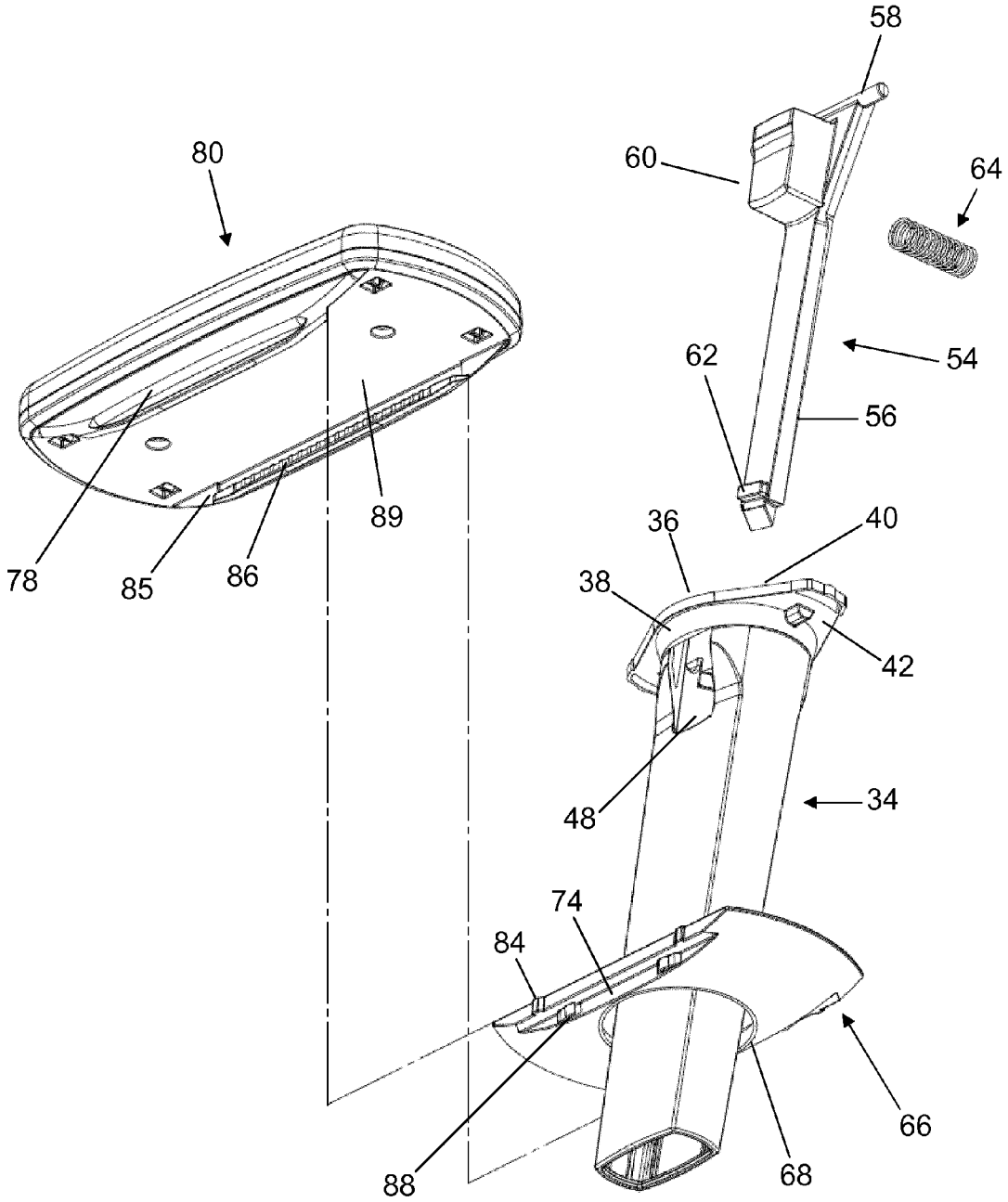
Figure 5:
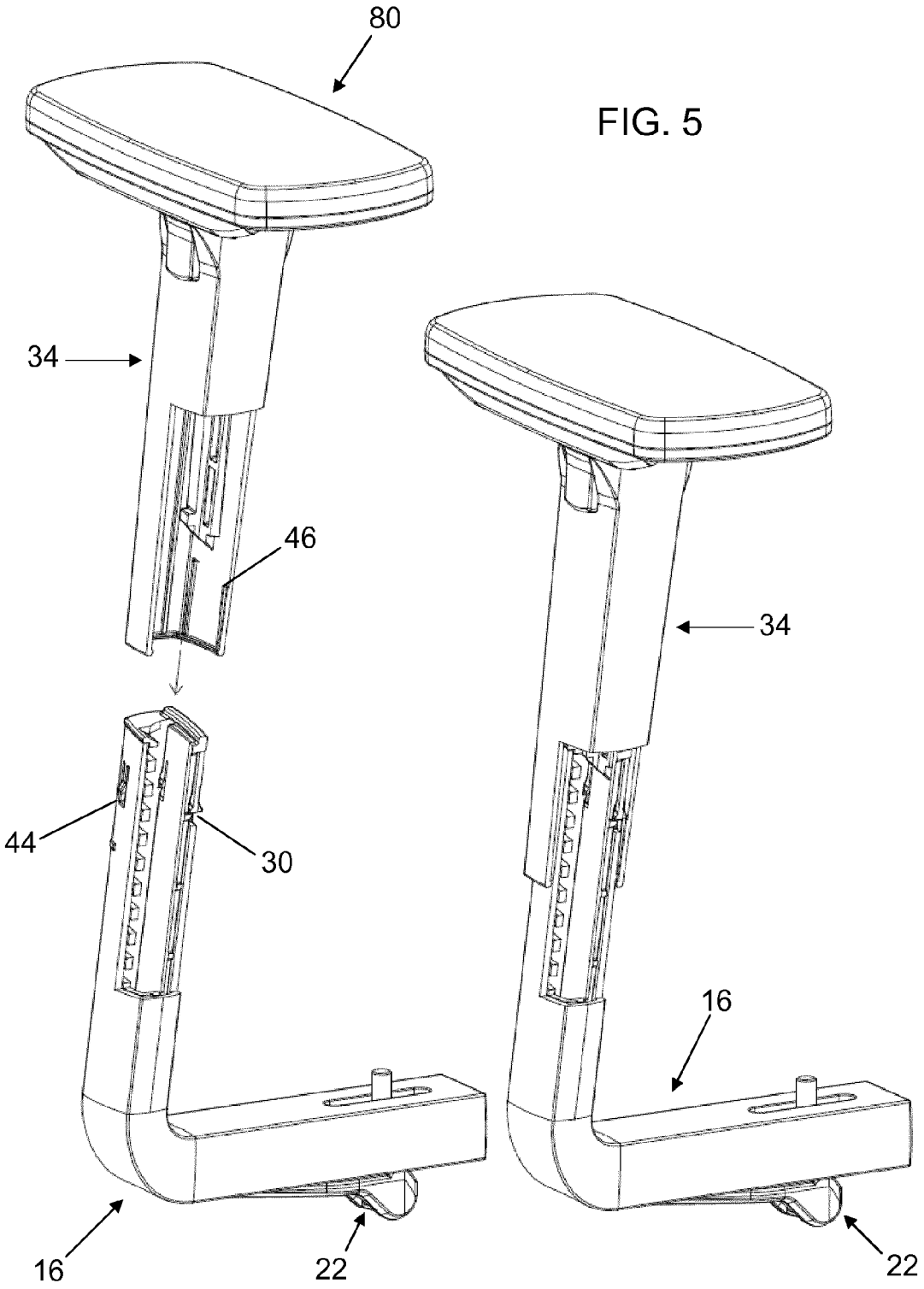
Figure 6:
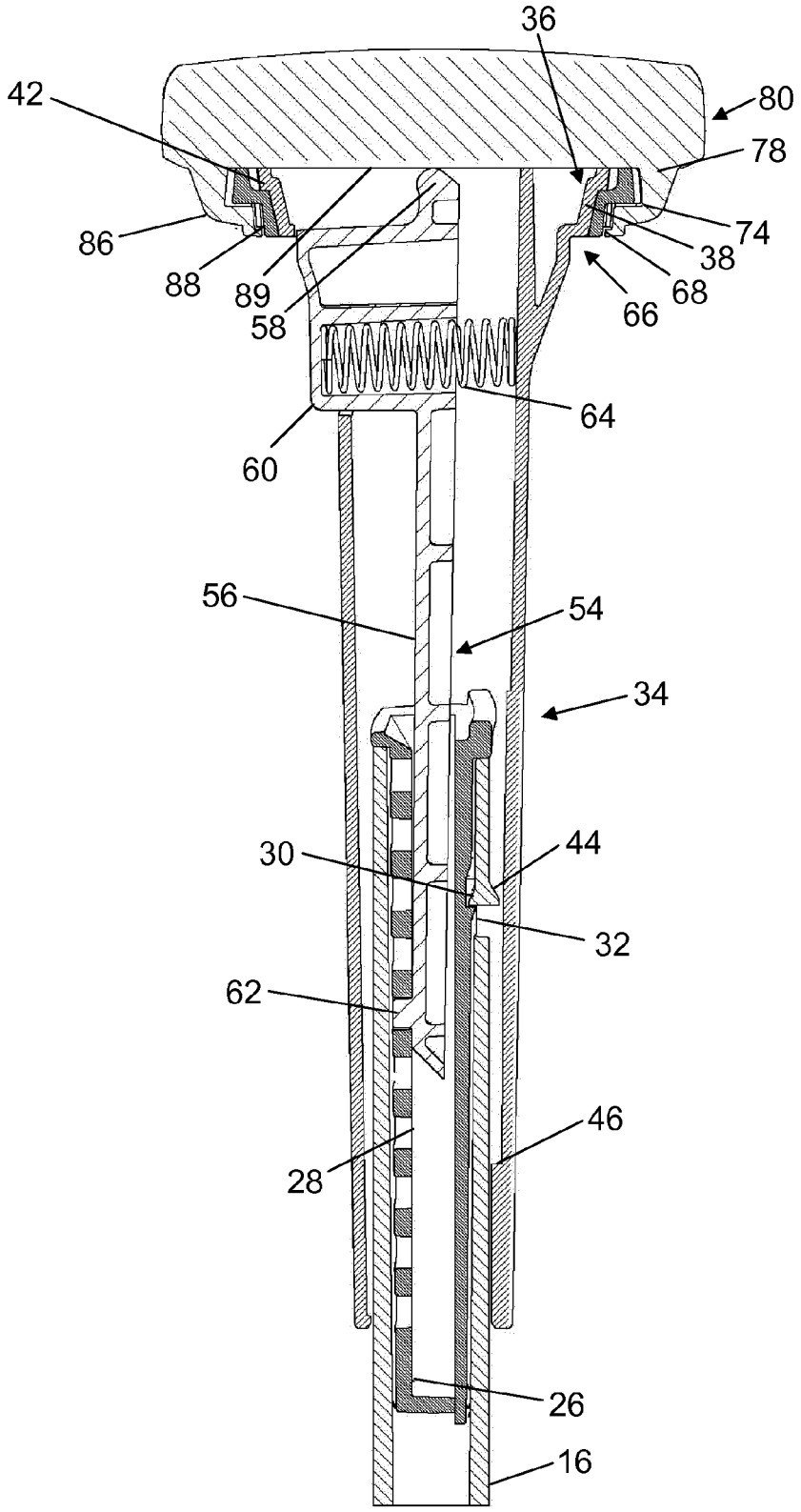

A preferred embodiment of the present invention is further clarified hereinafter with reference to the accompanying drawings, in which:

FIG. 1 is a perspective view of a chair provided with the armrest according to the invention, FIG. 2 shows the assembly of the first component of the armrest with the insertion-fitting of the plug into the bracket, FIGS. 3 and 4 are exploded perspective views showing the assembly of the second component of the armrest with application of the pad to the plate by interposing the armrest flange, FIG. 5 is a perspective view showing the final mounting of the second component onto the first, and FIG. 6 is a longitudinal section through the armrest according to the invention.

As can be seen from the figures, the armrest 2 according to the invention is applied to the support structure for the seating portion 4 of a chair, in particular an office chair.

The box 6 is fixed on the underside of the structure to house the swivel mechanism provided with traditional members 8 and in which the column of a gas spring 10 engages, which at its other end is supported by a spoked base 12 provided with wheels 14.

In particular, the armrest comprises a tubular L-shaped bracket 16 with its horizontal part 18 comprising a slotted hole 20 for the insertion of a screw 22 anchored to the seating portion support structure, enabling the distance of the armrest from the seating portion to be adjusted.

The vertical part 24 of the bracket houses internally a plug 26 provided with a plurality of slots 28.

In particular, the insertion-fitting of the plug 26 into the vertical part 24 is stabilized by the inner part of toothed strips 30 projecting into the interior of the cavity of the vertical part 24 of the bracket 16 and engaging in corresponding notches 32 provided in the plug.

The vertical part 24 of the bracket 16 with the plug 26 applied to it is slidingly inserted into a tube 34 with the upper end provided with a flange 36 consisting of a lower circumferential band 38 and an upper elliptical plate 40 the lower surface of which forms an abutment 42.

The limit stop, to prevent total withdrawal of the tube 34 from the vertical part 24, is obtained by engagement between the outer portion 44 of the toothed strips 30 and corresponding seats 46 provided in the inner lateral surface of the tube.

The lateral surface of the tube also comprises a hole 48 the function of which is clarified hereinafter.

The upper surface of the plate 40 is provided with two semi-cylindrical seats 50 and has its perimetral edge provided with two diametrically opposite flexible ribs 52.

A locking element 54 inserted into the tube 34 consists of an arm 56 provided upperly with a pin 58 the ends of which are housed in the semi-cylindrical seats 50 of a pushbutton 60 which projects from the hole 48 in the tube, and provided lowerly with a tooth 62 which under the action of a spring 64 selectively engages one of the slots 28 of the plug 26, depending on the position of the tube 34 relative to the vertical part 24 of the bracket 16.

A plate 66 applied to the tube 34 from below comprises a circular hole 68 of diameter corresponding to that of the circumferential band 38 such that said plate rests on the abutment surface 42. The circular hole 68 and the circumferential band 38 act as guides for the rotation of the plate 66 about the tube 34.

Said plate 66 is of substantially rectangular shape in plan and presents internally two baffles 70 provided with a plurality of grooves 72 selectively cooperating with the flexible ribs 52 of the flange 36.

The lower surface of the longitudinal parallel edges of the plate 66 comprises two steps 74 engagable by two corresponding fillets 78 projecting lowerly from the lower surface of a pad 80.

The fillets 78 converge inwards and consequently engage the two steps 74 of the plate 66 to securely retain the flange 40 interposed between them and hence retain the tube 34.

The lower surface 89 of the pad 80 retains, in the two semi-cylindrical seats 50 of the tube 34, the fulcrum pin 58 of the locking element 54.

The edges of the plate 66 and the inner surface of the fillets 78 respectively comprise flexible teeth 88 and grooves 86, which ensure stepwise movement of the pad relative to the plate 66.

Horizontal withdrawal of the pad 80 from said plate 66 is prevented by the presence of a limit stops 84 and 85 provided respectively on the lateral sides of the plate 66 and on the inside of the fillets 78 of the pad 80.

The armrest according to the invention is constructed without the need for tools by following a few particularly simple operations:

- the first component is assembled by coupling the plug 26 to the bracket 16 as shown in FIG. 2,
- the second component is assembled by mounting the pad 80 on the plate 66 which has been previously mounted about the tube 34 and made to abut against the flange 36, so coupling to the tube 34 all the interposed adjustment elements as shown in FIGS. 3 and 4,
- the two components are mounted by inserting the tube 34 into the bracket 16 as shown in FIG. 5.

Given the extreme simplicity of these operations the components can be assembled, stored and transported separately, to be coupled during the final stage of assembling the seating portion.

The arm of the invention is adjusted as follows:

width: the screws 22 are slackened and the L-shaped brackets 16 are slid along the slotted holes 20;

height: to adjust the height the pushbutton 60 of the rod 54 is pushed to disengage the tooth 62 from the corresponding slot 28 of the plug 26; In this manner the tube 34 can slide freely relative to the vertical part 24 of the bracket 16 until, having reached the desired height, the pushbutton is released to cause the spring 64 to engage the tooth in the chosen slot 28 facing it.

depth: this adjustment is achieved by sliding the pad 80 along the plate 66 with stepwise advancement given by the engagement between the flexible teeth 88 and the grooves 86.

angularity: this adjustment is achieved by rotating the pad 80 and the plate 66 connected thereto about the tube 34 and engaging the elastic ribs 52 stepwise in the grooves 72 of the plate 66.

In this manner the advantage is obtained of achieving an economical and reliable system with few components and with simplified assembly without tools. Moreover the ease of assembly makes it possible to store and transport partially assembled products, so achieving important logistical and storage cost advantages.

The invention claimed is:

1. An armrest, in particular for office chairs, comprising:

a support bracket (16) connected to a chair;

a tube (34) connected to a vertical part (24) of said support bracket; and an arm support pad, wherein the tube has at one end a flange (36) comprising a first rotation guide for a plate (66), said plate having an aperture (68) for insertion of a lower end of the tube (34) and being provided with a second rotation guide cooperating with said flange (36) for rotation of said plate (66) about said tube (34), said plate (66) and said pad (80) being constrained by mutually cooperating slide guides (74, 78, respectively), which enable said arm support pad (80) to translate relative to said plate (66) with said flange (36) interposed therebetween, wherein a lower surface (89) of said pad (80) is directly laying on an upper surface (40) of said flange (36), thereby enabling a contemporaneous translation and rotation of said pad (80) in relation to said tube (34).

2. The armrest as claimed in claim 1, wherein at least one of said rotation guides for said flange (36) and for said plate (66) consists of a circular band.

3. The armrest as claimed in claim 1, wherein said tube (34) slides along said support bracket (16) and includes a system (26, 28, 54, 60, 62, 64) configured for adjusting and locking its position.

4. The armrest as claimed in claim 3, wherein said system comprises a plug (26) with adjustment positions formed by holes (28) or teeth, said plug being insertion-mounted in said support bracket (16).

5. The armrest as claimed in claim 3, wherein said locking system comprises an element (60, 62, 64) elastically movable between a locking position and a release position, said element being hinged to the tube interposed between said pad (80) and said flange (36).

6. The armrest as claimed in claim 1, wherein said support bracket is of L-shape with a vertical part (24) engaged in the tube (34) and a horizontal part (18) connected to the chair.

7. The armrest as claimed in claim 6, wherein said horizontal part (18) is provided with an adjustment device (18) and a locking device (20) to adjust and respectively lock a distance of the armrest from the chair.

8. The armrest as claimed in claim 1, wherein the flange (36) has opposing outer portions with flexible ends, wherein said plate has a cavity therein which is defined, at an outer edge thereof, by opposing baffles with grooves therein, and wherein said cavity is configured to receive said outer portions of said flange and engage said flexible ends in said grooves during rotation.

* * * * *